US007561003B2

(12) United States Patent
Kroening

(10) Patent No.: US 7,561,003 B2
(45) Date of Patent: Jul. 14, 2009

(54) MULTI-JUNCTION WAVEGUIDE CIRCULATOR WITH OVERLAPPING QUARTER-WAVE TRANSFORMERS

(75) Inventor: Adam M. Kroening, Atlanta, GA (US)

(73) Assignee: EMS Technologies, Inc., Norcross, GA (US)

( * ) Notice: Subject to any disclaimer, the term of this patent is extended or adjusted under 35 U.S.C. 154(b) by 0 days.

(21) Appl. No.: 11/931,467

(22) Filed: Oct. 31, 2007

(65) Prior Publication Data

US 2009/0108953 A1 Apr. 30, 2009

(51) Int. Cl.
*H01P 1/38* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | |
|---|---|---|---|
| 3,221,255 | A | 11/1965 | Rabowsky et al. |
| 3,277,339 | A | 10/1966 | Simon |
| 3,339,158 | A | 8/1967 | Passaro |
| 3,341,789 | A | 9/1967 | Goodman et al. |
| 3,350,663 | A | 10/1967 | Siekanowicz et al. |
| 3,530,387 | A | 9/1970 | Bonfeld et al. |
| 3,582,831 | A | 6/1971 | Siekanowicz et al. |
| 3,710,280 | A | 1/1973 | Buck |
| 3,806,837 | A | 4/1974 | Carr et al. |
| 4,058,780 | A | 11/1977 | Riblet |
| 4,697,158 | A | 9/1987 | Hoover et al. |
| 4,810,979 | A | 3/1989 | Morz et al. |
| 5,266,909 | A | 11/1993 | Wolfert et al. |
| 5,608,361 | A | 3/1997 | Weiss et al. |
| 5,724,010 | A | 3/1998 | Brown |
| 6,885,257 | B2 | 4/2005 | Kroening |
| 7,176,767 | B2 | 2/2007 | Kroening |
| 7,230,507 | B2 | 6/2007 | Kroening |
| 7,242,263 | B2 | 7/2007 | Kroening |

(Continued)

FOREIGN PATENT DOCUMENTS

| | | |
|---|---|---|
| DE | 34 41 352 | 5/1986 |

(Continued)

OTHER PUBLICATIONS

Zaal: Some Experimental Results on the X-Band Junction Circulator, Transactions on Mirowave Theory and Techniques, vol. 13, No. 3 (May 1, 1965), pp. 382-383, XP0024889112.

*Primary Examiner*—Stephen E Jones
(74) *Attorney, Agent, or Firm*—Hogan & Hartson, LLP

(57) ABSTRACT

An improved multi-junction waveguide circulator overlaps two quarter-wave dielectric transformer sections so that the transitional sections occur concurrently in the same length of waveguide. Consequently, the two quarter-wavelength sections require a total length of between one-quarter wavelength and one-half wavelength, with no air gap between the two sections along the length of the internal cavity. The improved waveguide circulator can be implemented in variations from a minimum of two ferrite circulator elements held in close proximity to one another to any number of ferrite elements as required to achieve the desired isolation performance or to create a switch matrix with any combination of input and output ports. The improved waveguide circulator minimizes the length of the transitions between adjacent ferrite elements and thus reduces losses, component size, and mass.

21 Claims, 15 Drawing Sheets

U.S. PATENT DOCUMENTS

| | | | | |
|---|---|---|---|---|
| 7,280,004 | B2 | 10/2007 | Kroening | |
| 2005/0030117 | A1* | 2/2005 | Kroening | 333/1.1 |
| 2007/0139131 | A1 | 6/2007 | Kroening | |

FOREIGN PATENT DOCUMENTS

| | | |
|---|---|---|
| EP | 0 293 210 | 11/1988 |
| JP | 51-117853 | 10/1976 |
| JP | 53-135552 | 11/1978 |
| JP | 56-20301 | 2/1981 |
| JP | 2000-082901 | 3/2000 |
| JP | 2000332507 | 11/2000 |
| JP | 52-152145 | 2/2009 |
| WO | 02/067361 | 8/2002 |

* cited by examiner

MULTI-JUNCTION WAVEGUIDE CIRCULATOR WITH OVERLAPPING QUARTER-WAVE TRANSFORMERS

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of contract no. N00173-07-C-4000 awarded by the Naval Research Laboratory.

REFERENCE TO A "MICROFICHE APPENDIX"

Not Applicable

BACKGROUND OF THE INVENTION

1. Field of the Invention

The present invention relates in general to waveguide circulators for the non-reciprocal transmission of microwave energy; and more particularly to a novel system for reducing the size, mass, and insertion loss of the transition between adjacent circulators.

2. Description of the Related Art

Multi-junction waveguide ferrite circulator assemblies have a wide variety of uses in commercial and military, space and terrestrial, and low and high power applications. A waveguide circulator assembly may be implemented in a variety of applications, including but not limited to LNA redundancy switches, T/R modules, switch matrices, and switched-beam antenna systems. Ferrite circulators are desirable for these applications due to their high reliability, as there are no moving parts required. This is a significant advantage over mechanical switching devices. In most of the applications for multi-junction waveguide switching and non-switching circulators, small size, low mass, and low insertion loss are significant qualities, for example, in switched-beam antenna arrays where switches are located directly behind an antenna array.

A commonly used type of waveguide circulator has three waveguide arms arranged at 120° and meeting in a common junction. This common junction is loaded with a non-reciprocal material such as ferrite. When a magnetizing field is created in this ferrite element, a gyromagnetic effect is created that can be used for circulating the microwave signal from one waveguide arm to another. By reversing the direction of the magnetizing field, the direction of circulation between the waveguide arms is reversed. Thus, a switching circulator is functionally equivalent to a fixed-bias circulator but has a selectable direction of circulation. Radio frequency (RF) energy can be routed with low insertion loss from one waveguide arm to either of the two output arms. If one of the waveguide arms is terminated in a matched load, then the circulator acts as an isolator, with high loss in one direction of propagation and low loss in the other direction.

For applications where additional isolation is required between waveguide ports or where additional input/output ports are required, multiple waveguide circulators and isolators are used. The most basic building blocks for multi-junction waveguide circulator networks are single circulator junctions, optimized for an impedance match to an air-filled waveguide interface. For the purposes of this description, the terms "air-filled," "empty," "vacuum-filled," or "unloaded" may be used interchangeably to describe a waveguide structure. The circulators can be connected in various configurations as required for the desired isolation and input/output port configuration. The direction of circulation may either be fixed or switchable.

Conventional waveguide networks comprised of multiple ferrite elements typically have impedance-matching transition and an air-filled waveguide section between the ferrite elements. For example, conventional waveguide circulators may transition from one ferrite element to a dielectric-filled waveguide such as a quarter-wave dielectric transformer structure, to an air-filled waveguide section, and then back to another dielectric-filled waveguide section and the next ferrite element. The dielectric transformers are typically used to match the lower impedance of the ferrite element to that of the air-filled waveguide. The air-filled waveguide section between quarter-wave dielectric transformers is designed to be sufficiently long, generally at least a quarter-wavelength, so as to allow the fields to transition back to the standard waveguide $TE_{1,0}$ mode between circulators. Thus, the conventional transition between ferrite elements occurs over a length of three-quarters of a wavelength or greater between adjacent ferrite elements. This sets the minimum separation distance that can be obtained in multi-junction assemblies when the input/output ports of multiple circulators are intercoupled to provide a more complex microwave switching or isolation arrangement. This can result in a multi-junction waveguide structure that is undesirably large and heavy. Furthermore, the insertion loss of a multiple circulator assembly increases as the separation distance between ferrite elements is increased as a result of the finite conductivity of the waveguide structure.

Referring now to FIG. 1, there is shown a top view of a conventional two-junction waveguide circulator structure. Magnetizing windings 109 are inserted through apertures in each leg of the ferrite elements 102 in order to establish a magnetizing field in each ferrite element. The polarity of this field can be switched back-and-forth by the application of current on the magnetizing winding to create a switchable circulator. Each of the ferrite elements have a quarter-wave dielectric transformer 110 or 111 attached to each leg. There are two transformers 110 attached to the adjacent legs of the ferrite elements and four transformers 111 attached to the remaining legs of the elements. As shown in FIG. 1, there is a substantial air gap of distance "G" between the quarter-wave dielectric transformers 110 that are attached to the adjacent legs of the ferrite elements. This distance "G" is typically longer than a quarter-wavelength. Dielectric spacers 112 are disposed on the top and bottom surfaces of the two ferrite elements. In FIG. 1, the bottom spacers are hidden from view. These dielectric spacers are used to properly position the ferrite elements in the conductive waveguide structure 100 and to provide a thermal path out of the ferrite elements to the conductive waveguide structure for high power applications. The conductive waveguide structure may include waveguide input/output ports 121, 122, 123, and 124. These ports provide interfaces, such as for signal input and output, for example. Empirical matching elements are not shown, but they may be disposed on the surface of the conductive waveguide structure to affect the performance. The matching elements may be capacitive/inductive dielectric or metallic buttons that are used to empirically improve the impedance match over the desired operating frequency band.

Previous patents have described approaches for decreasing the spacing and loss between the ferrite elements by replacing the standard quarter-wave dielectric transformers with a reduced height waveguide transition. This method removes the quarter-wave dielectric transformers, but the reduced height transition is sensitive to dimensional variations, which results in a design that is expensive and difficult to manufacture and assemble. Other patents have described approaches for eliminating the quarter-wave dielectric transformers between ferrite elements. These methods provide size and insertion loss benefits, but this comes at the expense of isolation and frequency bandwidth.

In view of the problems with the conventional waveguide circulator structures disclosed above, there is a need for a multi-junction waveguide circulator structure that provides improvements in the critical areas of size, mass, and insertion loss without sacrificing the manufacturability or isolation performance of the assembly.

SUMMARY

The present invention improves upon traditional multi-junction waveguide circulators by overlapping two quarter-wave dielectric transformer sections so that these quarter-wave dielectric transformer sections occur concurrently in the same length of waveguide. Instead of using the typical method of transitioning from one ferrite element to a dielectric-filled waveguide to an air-filled waveguide and then back to another dielectric-filled waveguide section and into the next ferrite element, the invention eliminates the air-filled waveguide section resulting in a 0 to 100% overlap of adjacent quarter-wave dielectric transformers along the same length of waveguide. Consequently, the two quarter-wavelength sections require a total length of between one-quarter wavelength and one-half wavelength. In traditional multi-junction waveguide circulators, the length of the two quarter-wavelength transitional sections is generally greater than three-quarters of a wavelength.

The quarter-wave dielectric transformers are generally relatively thin (for example, less than about 0.015" (0.381 mm) thick for operations at about 40 GHz), which helps to minimize the impact of the additional dielectric loading of the overlapping section on the impedance match. Any effects of the additional dielectric loading can be accounted for by selecting different dimensions for the overlapping and non-overlapping quarter-wave dielectric transformers as determined using the traditional analytical and empirical means of optimization. As known in the prior art, empirical matching elements may also be disposed on the surface of the conductive waveguide structure to further affect the performance. The matching elements are generally capacitive/inductive dielectric or metallic buttons that are used to empirically improve the impedance match over the desired operating frequency band.

The waveguide circulator in accordance with the invention can be implemented in variations from a minimum of two ferrite circulator elements held in close proximity to one another to any number of ferrite elements as required to achieve the desired isolation performance or to create a switch matrix with any combination of input and output ports. The waveguide circulator in accordance with the invention minimizes the length of the transitions between adjacent ferrite elements and thus reduces losses, component size, and mass.

In one aspect of the invention, a ferrite circulator having a waveguide structure with an internal cavity is provided. The waveguide structure includes a plurality of ports extending from the internal cavity and at least two ferrite elements disposed in the internal cavity. A first ferrite element has a first quarter-wave dielectric transformer and an adjacent second ferrite element has a second quarter-wave dielectric transformer, wherein at least a portion of the first and second quarter-wave dielectric transformers overlap along a length of the internal cavity.

In another aspect of the invention, a ferrite circulator having a waveguide structure with an internal cavity is provided. The waveguide structure includes a plurality of ports extending from the internal cavity and at least two ferrite elements disposed in the internal cavity. A single transformer is located between the at least two ferrite elements. The single transformer has the functionality of two quarter-wave dielectric transformers, the first ferrite element and the second ferrite element being separated by a distance between no more than the length of two quarter-wave dielectric transformers at an operating frequency.

In still another aspect of the invention, a ferrite circulator having a waveguide structure with an internal cavity, the waveguide structure including a plurality of ports extending from the internal cavity is provided. A first ferrite element is disposed in the internal cavity, the first ferrite element having at least a first and a second quarter-wave dielectric transformer. A second ferrite element is disposed in the internal cavity adjacent to the first ferrite element, the second ferrite element having a third quarter-wave dielectric transformer disposed such that at least a portion of the first and third quarter-wave dielectric transformers overlap along a length of the internal cavity so that first and second ferrite element are separated by a distance between no more than the length of two quarter-wave dielectric transformers at an operating frequency. A third ferrite element is disposed in the internal cavity adjacent to the first ferrite element, the third ferrite element having a fourth quarter-wave dielectric transformer. The third ferrite element is disposed such that no portions of the second and fourth quarter-wave dielectric transformers overlap along a length of the internal cavity.

Additional advantages of the invention will be set forth in the description which follows, and in part will be obvious from the description, or may be learned by practice of the invention. The advantages of the invention may be realized and obtained by the instrumentalities and combinations particularly pointed out hereinafter.

BRIEF DESCRIPTION OF THE DRAWINGS

The accompanying drawings are included to provide further understanding of the invention and are incorporated in and constitute a part of this specification. The accompanying drawings illustrate embodiments of the invention and together with the description serve to explain the principles of the invention. In the Figures.

DETAILED DESCRIPTION OF THE INVENTION

Reference will now be made in detail to the preferred embodiments of the invention, examples of which are illustrated in the accompanying drawings. It important to note that while the embodiments below illustrate the ferrite element as having a Y-shape with three legs, the invention also includes a variety of differing shapes, including a triangular puck or rectangular puck shape. While these shapes may not be considered to have legs as described below, they nevertheless have particularly protruding portions which may operate in a manner similar to the toroid legs described below.

Figure 2:
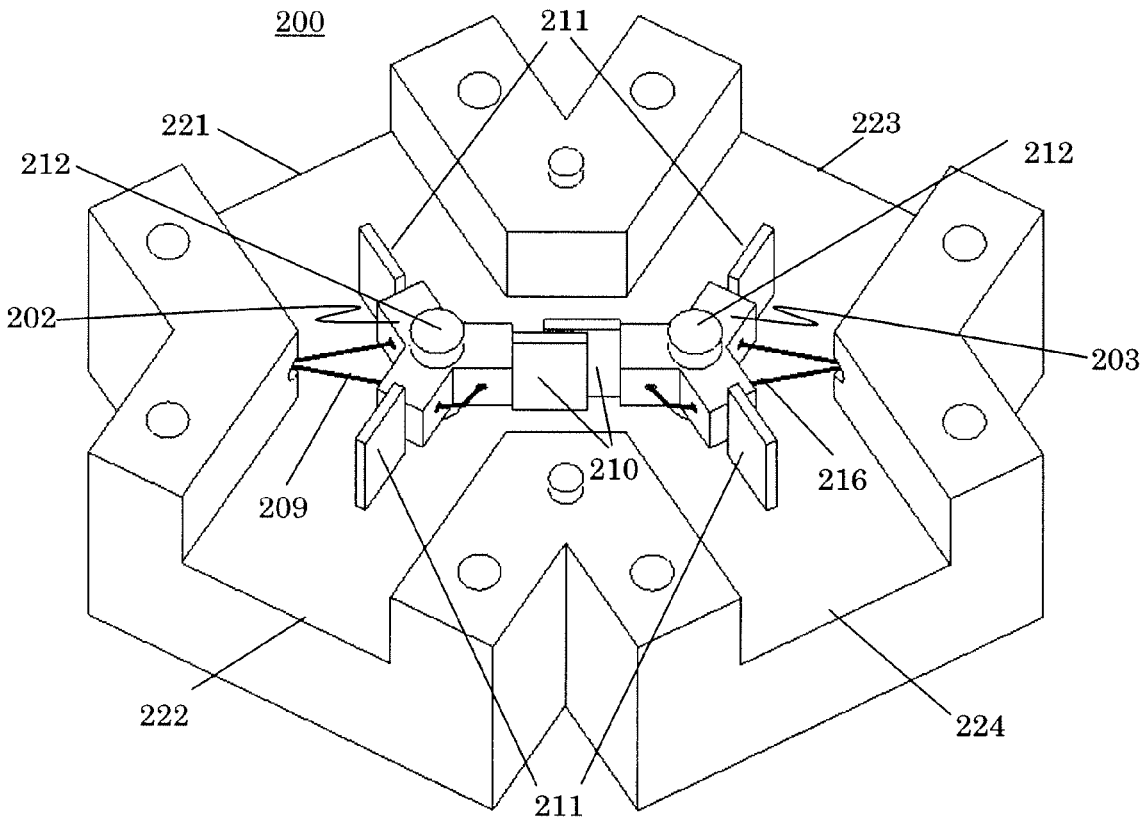
FIG. 2 shows a perspective view of the internal portion of a two-junction waveguide circulator structure incorporating two partially overlapping dielectric quarter-wave transformers slightly offset from center according to one embodiment of the present invention.

FIG. 2 shows a perspective view of a two-junction waveguide circulator structure in accordance with a first embodiment of the invention. Magnetizing windings 209 and 216 are inserted through apertures in each leg of the ferrite elements 202 and 203, respectively, in order to establish a magnetizing field in the ferrite element. The polarity of this field can be switched back-and-forth by the application of current on the magnetizing windings 209, 216 to create a switchable circulator. Dielectric spacers 212 are disposed on the top and bottom surfaces of the two ferrite elements. The bottom spacers are partially hidden from view. These dielectric spacers are used to properly position the ferrite elements in the conductive waveguide structure 200 and to provide a thermal path out of the ferrite elements to the conductive waveguide structure for high power applications. The conductive waveguide structure may include waveguide input/output ports 221, 222, 223, and 224. These ports provide interfaces, such as for signal input and output, for example. As known in the prior art, empirical matching elements (shown, e.g., as 219 in FIGS. 7 and 8) may be disposed on the surface of the conductive waveguide structure to affect the performance. The matching elements may be capacitive/inductive dielectric or metallic buttons that are used to empirically improve the impedance match over the desired operating frequency band.

Each of the ferrite elements have a quarter-wave dielectric transformer 210 or 211 attached to each leg. Note that, as in conventional designs, the length of the quarter-wave dielectric transformers may deviate in length from a standard calculation of a quarter-wavelength. The standard calculation of a quarter-wavelength distance can be determined given the height and width of the waveguide and the width and dielectric constant of the quarter-wave dielectric transformer. In an exemplary design for the 37 to 40 GHz frequency range, the waveguide dimensions are those of standard WR-22 waveguide, the width of the dielectric transformer is 0.011 inches (0.279 mm) and the relative dielectric constant is 4.5. Given these values, a quarter-wavelength is approximately 0.080 inches (2.032 mm) using standard calculation methods. However, optimal performance was realized using a length of 0.067 inches (1.702 mm) for the quarter-wave dielectric transformers. In practice, the length of the quarter-wave dielectric transformer may deviate from the standard calculation due to discontinuities in the propagation modes between the ferrite-loaded, dielectric-loaded, and air-filled waveguide sections. It is not uncommon for the standard calculation and the actual length of the quarter-wave dielectric transformers to differ by up to 25%.

Figure 3:
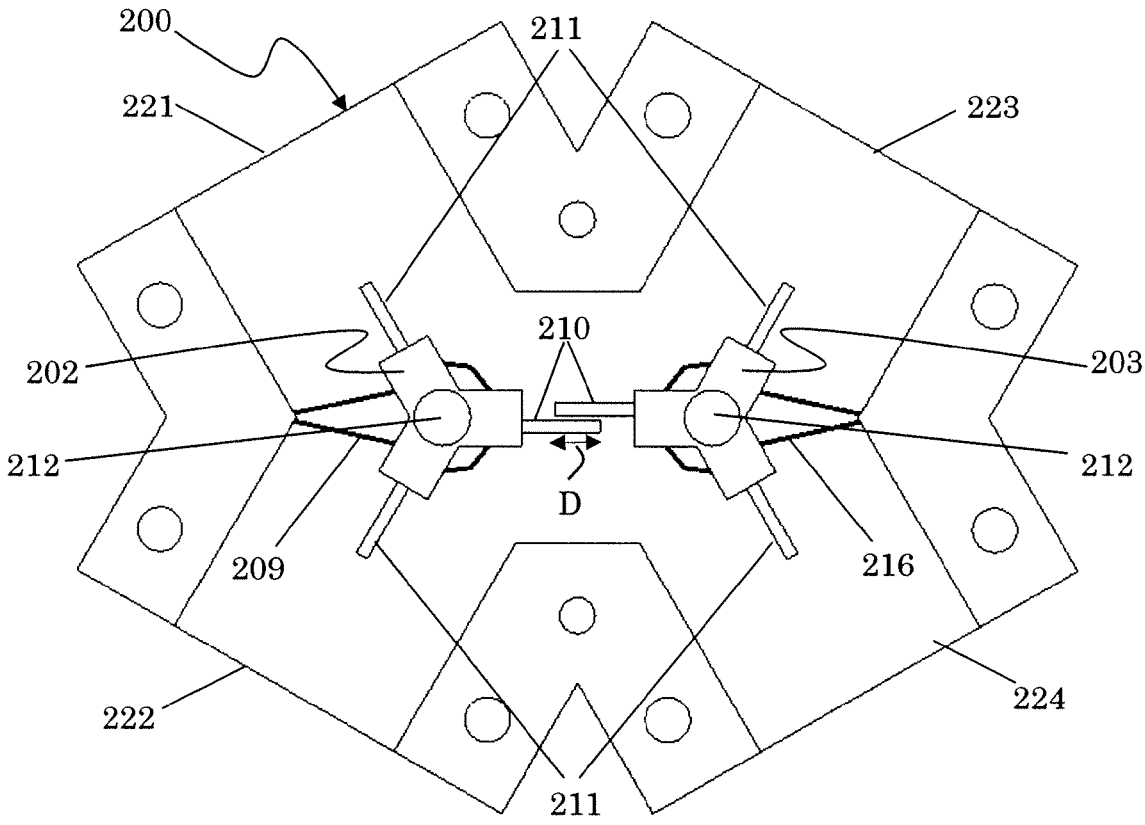
FIG. 3 shows a top view of the structure shown in FIG. 2.

There are two quarter-wave dielectric transformers 210 attached to the adjacent legs of the ferrite elements and four transformers 211 attached to the remaining legs of the elements. As shown in FIG. 2, the quarter-wave dielectric transformers 210 that are attached to the adjacent legs of the ferrite elements overlap along the length of the transformers so that portions of both transformers are contained within the same section of waveguide. FIG. 3 shows a top view of the structure of FIG. 2. In FIG. 3, the length of the overlapping region between the adjacent quarter-wave dielectric transformers 210 is denoted as "D." It is important to note that there is no air-filled waveguide section separating the adjacent ferrite elements 202 and 203. The waveguide region between the ferrite elements contains either one or two quarter-wave dielectric transformers 210 along the entire length. As illustrated in FIG. 3, the overlap of the two quarter-wave dielectric transformers in this embodiment is roughly 50% of their length or one-eighth of a wavelength. This results in a spacing of approximately three-eighths of a wavelength between the ferrite elements. The additional embodiments described below will show that the overlap can vary from 0% to 100%. As shown in FIG. 3, the adjacent quarter-wave dielectric transformers 210 are spaced very closely to one another along the waveguide width (the direction perpendicular to the transformers 210), leaving a de minimus air gap. The additional embodiments described below will show that this separation distance along the waveguide width is not critical.

In operation as a 1 input/3 output switch, an RF signal is provided as input to the waveguide port 221 and is delivered as output through either waveguide port 222, 223, or 224. The signal enters the waveguide structure 200 through waveguide port 221 and, depending upon the direction of magnetization of ferrite element 202, either passes through ferrite element 202 and out waveguide port 222 or passes through both ferrite elements 202 and 203 and out waveguide port 223 or 224. The direction of signal propagation through a ferrite element can be described as clockwise or counter-clockwise with respect to the center of the ferrite element. For example, if the signal input through waveguide port 221 passes in a clockwise direction through ferrite element 202, it will propagate in the direction of the second ferrite element 203. For this signal to continue through the second ferrite element 203 towards port 224, the magnetization of ferrite element 203 should be established so as the propagating signal passes in the counter-clockwise direction. The RF signal will thereby exit through waveguide port 224 with low insertion loss. Summarizing the above-described scenario, the RF signal propagates from the input port 221 to the output port 224 with low insertion loss (effectively ON) and from the input port 221 to the other two output ports 222 and 223 with high insertion loss (effectively OFF or isolated).

To change the low loss output port from output port 224 to output port 223, a magnetizing current is now passed through magnetizing winding 216 so as to cause circulation through ferrite element 203 in the clockwise direction. The magnetic bias of ferrite element 202 is also established so that the input signal will propagate in a clockwise direction with respect to the center junction of ferrite element 202. This allows the RF signal to propagate from the input port 221 to output port 223 with low insertion loss (effectively ON) and from the input port 221 to the other two output ports 222 and 224 with high insertion loss (effectively OFF or isolated).

Figure 1:
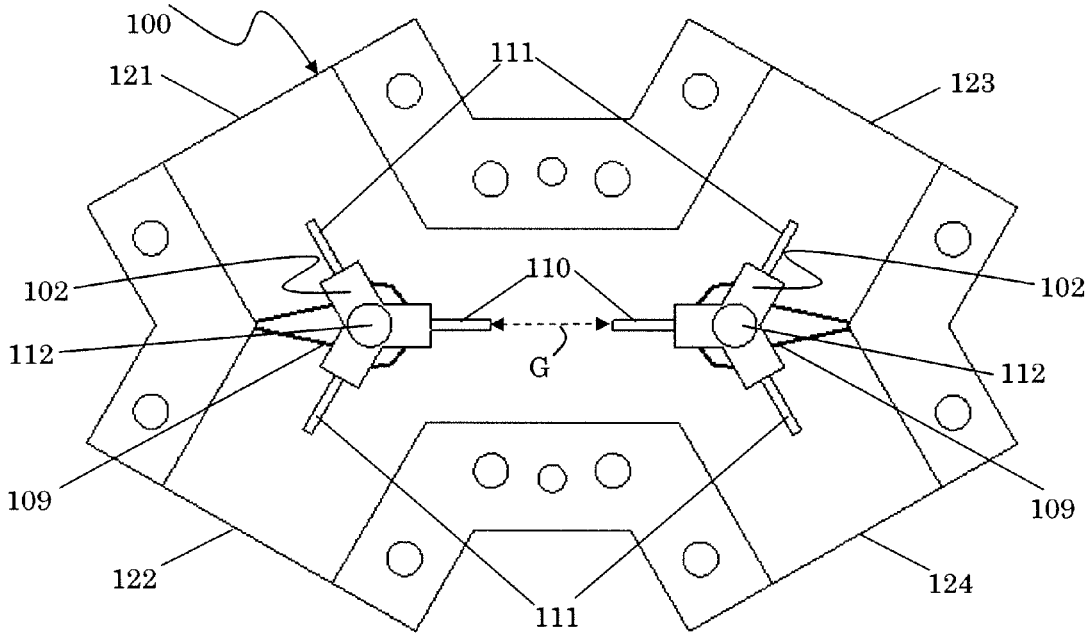
Figure 1 (PRIOR ART)
FIG. 1 shows a top view of a conventional two-junction waveguide circulator structure.
Figure 4:
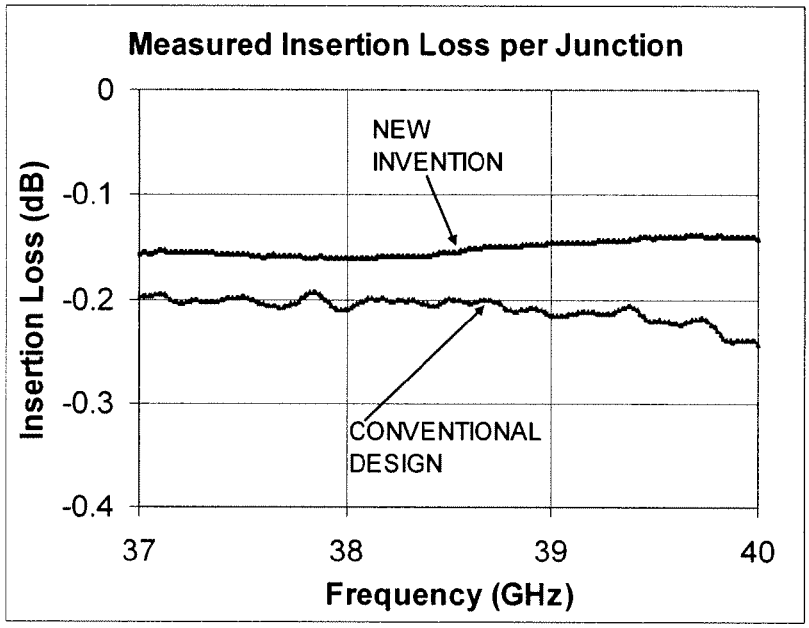
FIG. 4 compares measured data for a prototype of the design shown in FIG. 2 to measured data for a conventional design as shown in FIG. 1, exemplary of the Ka-band of operating frequency.

In the conventional designs, as was shown in FIG. 1, a distance "G" of air-filled waveguide is employed in the transition from one ferrite element to another. In the embodiment of FIG. 2 and FIG. 3, the air-filled waveguide section is removed and the ferrite elements are moved closer to one another by an additional distance of "D," which is the overlap in the length of the quarter-wave dielectric transformers 210. Thus, the distance between the ferrite elements is decreased by a total length of G+D in embodiments of the present invention. This reduction in transition length leads to lower insertion loss as well as smaller size and weight for multi-junction circulator assemblies. In an exemplary design for the 37 to 40 GHz frequency range, the air-filled waveguide length "G" would generally be at least 0.1 inches for a conventional design and the overlap length "D" is designed to be 0.030 inches in the new invention. This length of "D" provides a quarter-wave dielectric transformer overlap of approximately 40% in comparison to the 0.075 inch length of the quarter-wave dielectric transformers. In this example, the invention provides a savings of 0.13 inches in the spacing between ferrite elements or roughly one-third of a waveguide wavelength. This size improvement becomes more important in larger groupings of circulators, as will be illustrated in additional embodiments described below. The improvement in size also leads to improvements in loss, as shown in FIG. 4. FIG. 4 contains a plot comparing the insertion loss per circulator for the new invention and the prior art. The conventional design has approximately 0.04 dB more loss per circulator junction due to the additional waveguide losses over the longer length. The other RF performance parameters, such as isolation and return loss are similar for the conventional designs and the new invention. The dimensions of the ferrite element, dielectric spacers, and waveguide cross-section are the same as in conventional designs, so the conventional methods of design through empirical methods or proprietary or commercially-available design software can be employed. Although the exemplary design is for the 37 to 40 GHz range, it should be understood that this invention can be applied to any frequency of operation for waveguide circulators using quarter-wave dielectric transformers, typically encompassing the 1 to 110 GHz frequency range.

Other patents have described approaches for eliminating the quarter-wave dielectric transformers between ferrite elements. In an exemplary design for the 37 to 40 GHz frequency range, the spacing between ferrite elements is approximately 0.1 inches longer in the new invention than in the prior patents. However, the new invention operates over a broader frequency range than the prior patents due to the use of the quarter-wave dielectric transformers. Furthermore, the new invention provides higher isolation of approximately 20 to 25 dB per circulator junction versus 15 to 20 dB per circulator junction for the prior patent.

Figure 5:
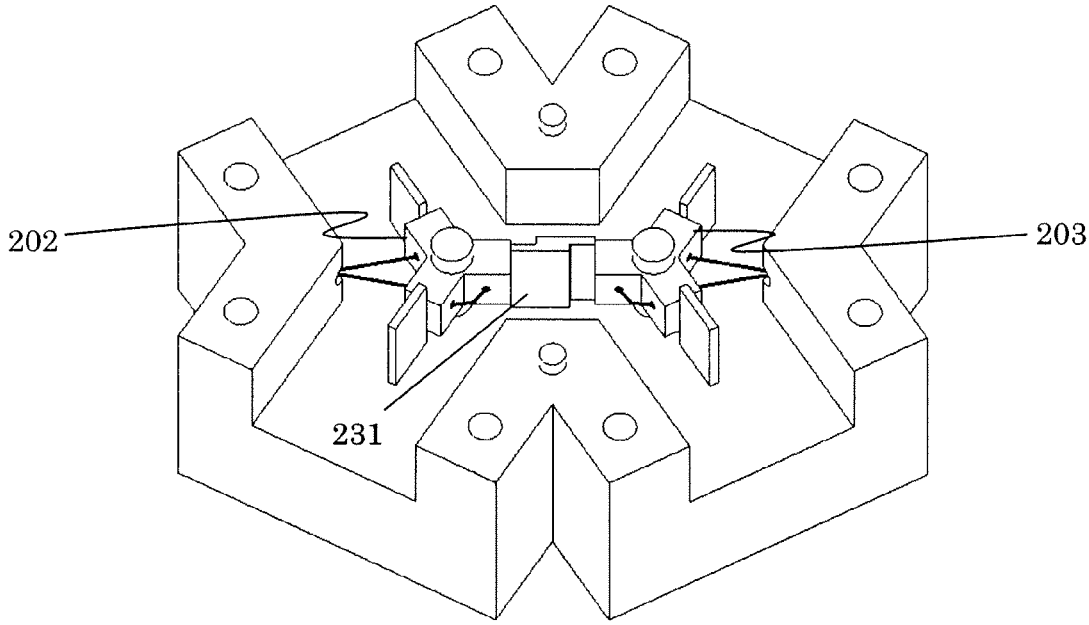
FIG. 5 shows a perspective view of the internal portion of a two-junction waveguide circulator structure incorporating two partially overlapping dielectric quarter-wave transformers manufactured as a single piece according to one embodiment of the present invention.
Figure 6:
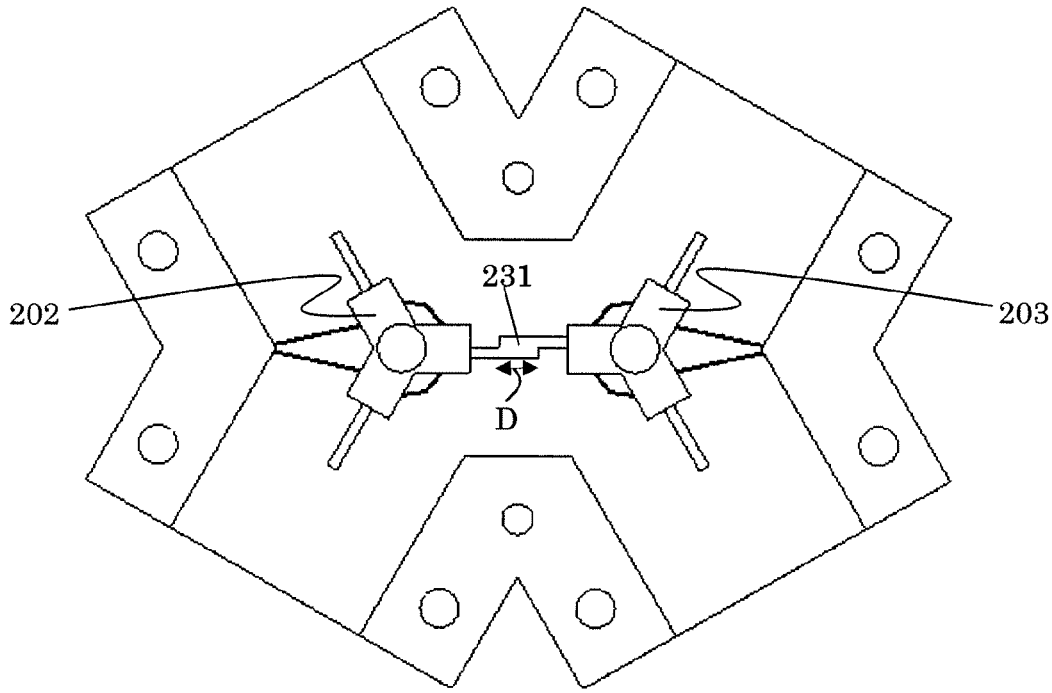
FIG. 6 shows a top view of the structure shown in FIG. 5.

Referring now to FIG. 5, there is shown a perspective view of another embodiment of the device according to the present invention. This embodiment is different from that of FIG. 2 in that the two quarter-wave dielectric transformers 210 have been replaced by a single transformer 231, which has the functionality of two quarter-wave dielectric transformers. The FIG. 2 embodiment utilizes a de minimus air gap between the two quarter-wave dielectric transformers. If a multi-junction waveguide circulator is used in a high power application or in an application that sees a wide range of temperatures, differences in the coefficients of thermal expansion between the ferrite elements 202 and 203 and the conductive waveguide structure 200 could stress the adhesive bond lines that constrain all of the individual pieces to the waveguide structure. The higher the stress in the bond lines, and the greater the chances of breaking an adhesive bond line or damaging a ferrite element. Thus, the embodiment of FIG. 2 may be preferable in certain applications. However, if adhesive bond line stress is not a concern, then the embodiment of FIG. 5 has the advantage of a lower parts count and lower cost. The dimensions of the transformer 231 in FIG. 5 would be the same as the combination of the two FIG. 2 quarter-wave dielectric transformers 210 with no air gap. This is illustrated in FIG. 6, which is a top view of the FIG. 5 embodiment.

Figure 7:
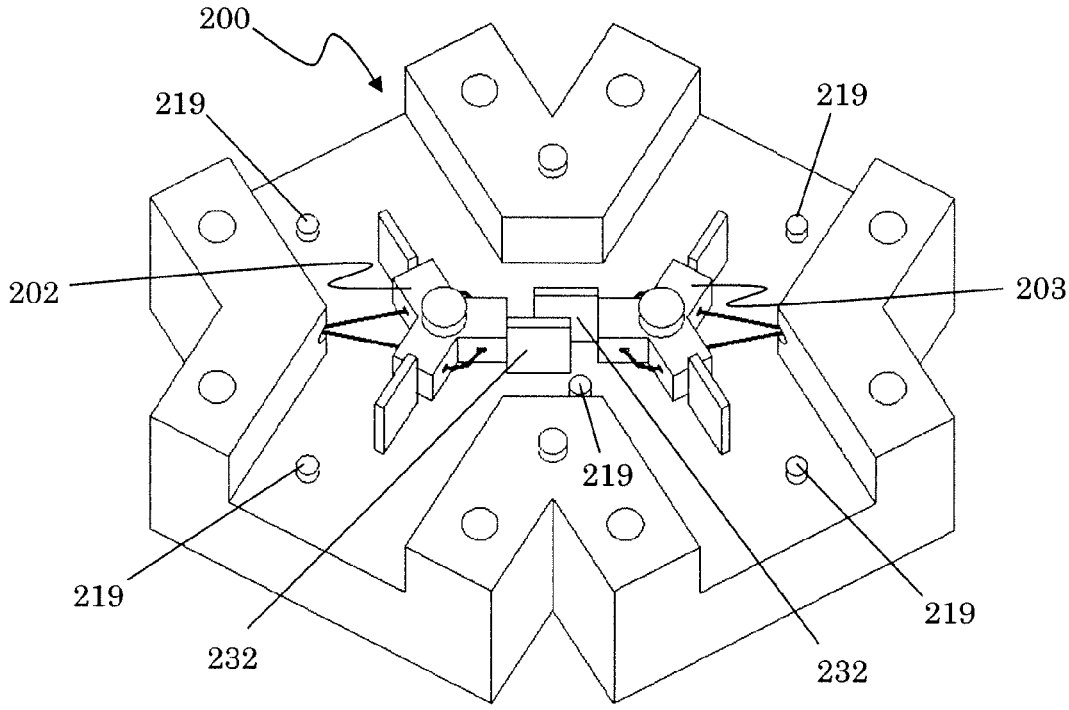
FIG. 7 shows a perspective view of the internal portion of a two-junction waveguide circulator structure incorporating two partially overlapping dielectric quarter-wave transformers offset from center and aligned with the opposite edges of the ferrite elements according to one embodiment of the present invention.
Figure 8:
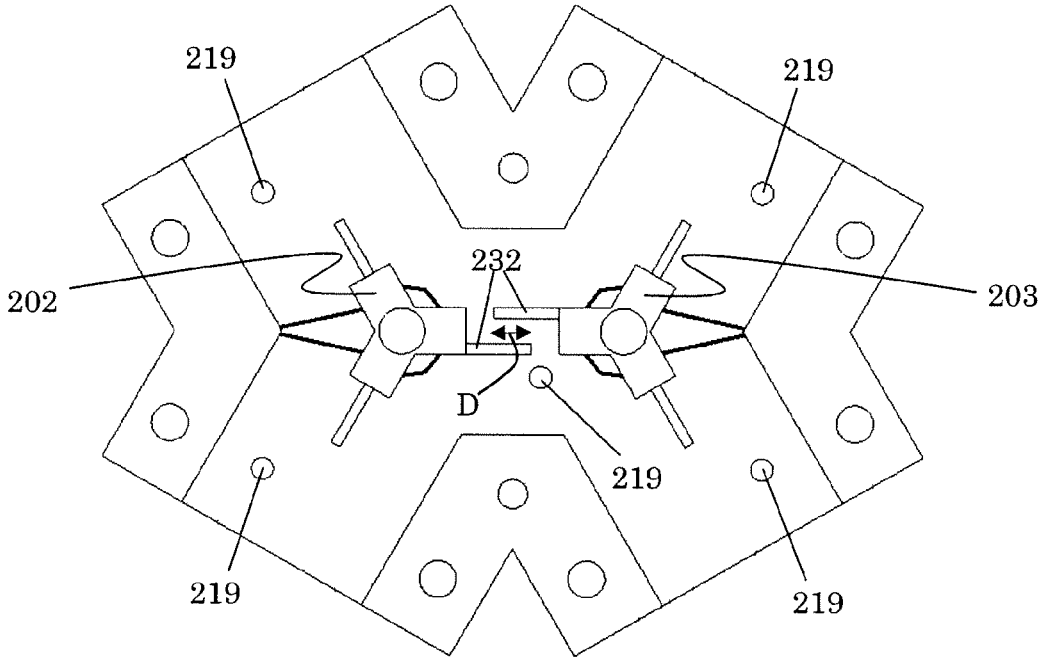
FIG. 8 shows a top view of the structure shown in FIG. 7.

Referring now to FIG. 7, there is shown a perspective view of another embodiment of the device according to the present invention. FIG. 8 contains a top view of the embodiment of FIG. 7. Whereas the FIG. 2 and FIG. 3 embodiment utilizes a de minimus air gap between the two quarter-wave dielectric transformers 210, the embodiment of FIG. 7 and FIG. 8 shows that the two quarter-wave dielectric transformers 232 can be moved closer to the outside edges of the ferrite elements 202 and 203, resulting in a gap between the transformers that is several times greater than the width of the transformers. Note that the FIG. 7 and FIG. 8 embodiment utilizes the same overlap length "D" between the two quarter-wave dielectric transformers 232 as in the FIG. 2 and FIG. 3 embodiment. FIGS. 7 and 8 also include optional empirical matching elements 219 disposed on the surface of the conductive waveguide structure 200 to affect the performance. The matching elements 219 may be capacitive/inductive dielectric or metallic buttons that are used to empirically improve the impedance match over the desired operating frequency band. Although the matching elements 219 are shown only in FIGS. 7 and 8, they may be similarly included in any of the other embodiments described herein.

Figure 9:
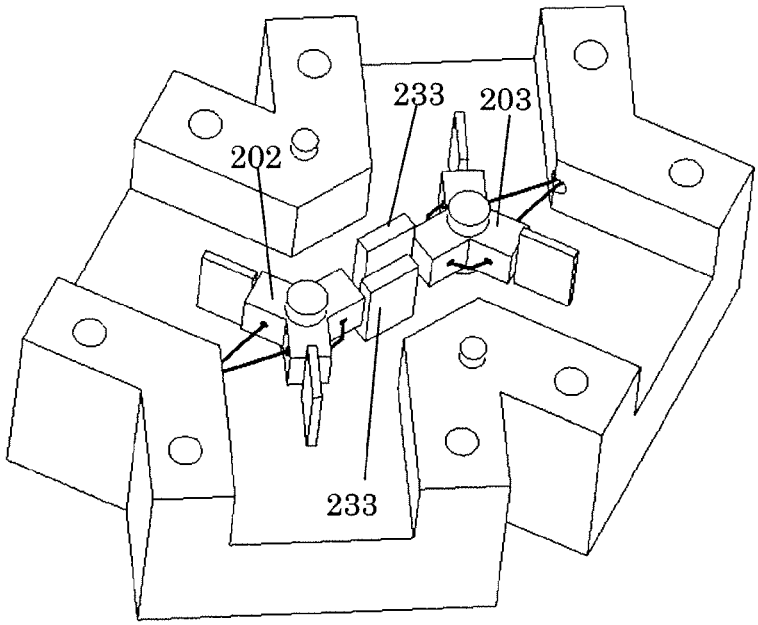
FIG. 9 shows a perspective view of the internal portion of a two-junction waveguide circulator structure incorporating two partially overlapping dielectric quarter-wave transformers offset from center and aligned beyond the opposite edges of the ferrite elements according to one embodiment of the present invention.
Figure 10:
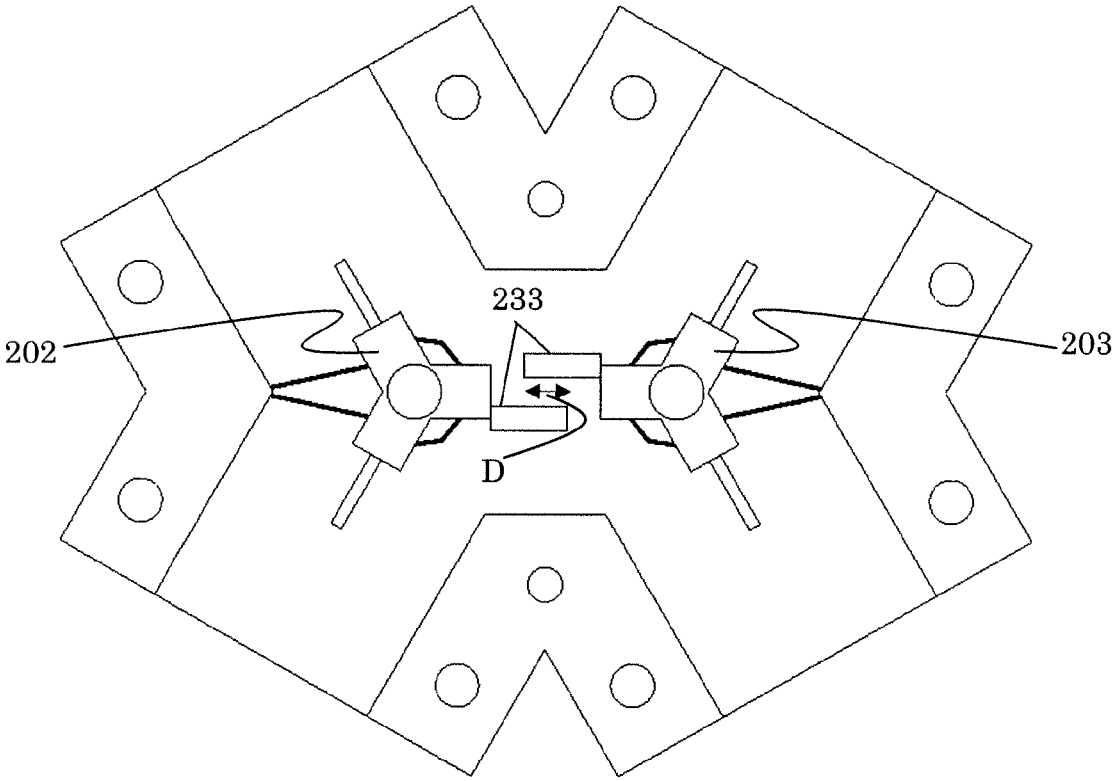
FIG. 10 shows a top view of the structure shown in FIG. 9.

Referring now to FIG. 9, there is shown a perspective view of another embodiment of the device according to the present invention. FIG. 10 contains a top view of the embodiment of FIG. 9. This embodiment shows that the two quarter-wave dielectric transformers 233 can extend beyond the edges of the ferrite elements 202 and 203. Note that the FIG. 9 and FIG. 10 embodiment utilizes the same overlap length "D" between the two quarter-wave dielectric transformers 233 as in previous embodiments; however, the transformers 233 have been made thicker in width than in the previous embodiments. This embodiment illustrates the fact that as the quarter-wave dielectric transformers 233 are moved farther from the center line of the waveguide, the width of the transformers can be increased to provide similar impedance to that of a centered transformer. The size and location of the overlapping quarter-wave dielectric transformers can be determined empirically, either through design prototypes or by the use of finite element analysis software. Additionally, empirical matching elements (not shown) may be disposed on the surface of the conductive waveguide structure to affect the performance as known in the prior art.

Figure 11:
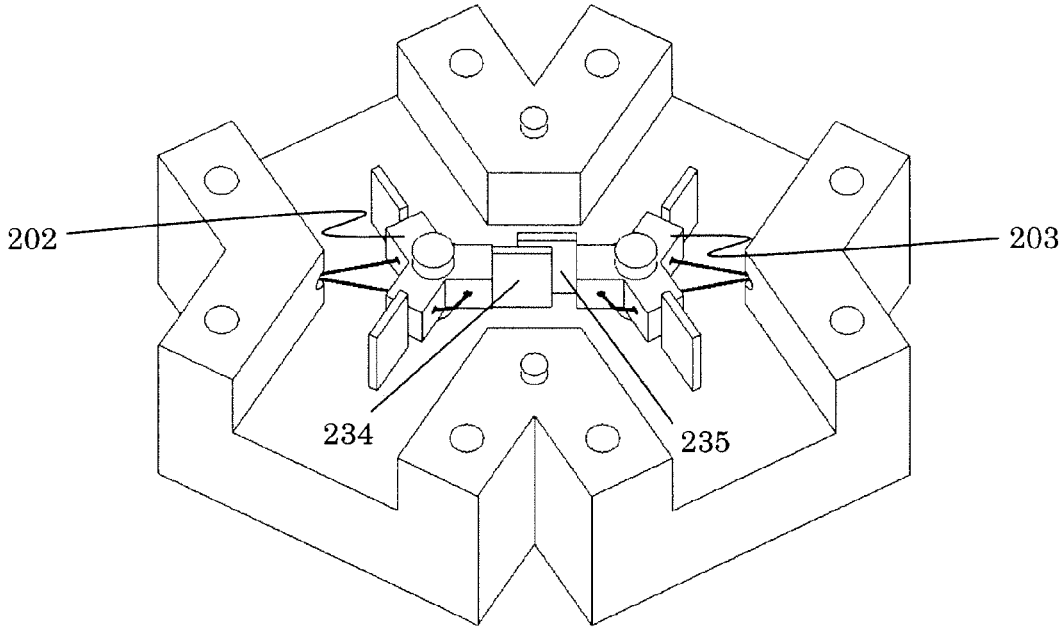
FIG. 11 shows a perspective view of the internal portion of a two-junction waveguide circulator structure incorporating two partially overlapping dielectric quarter-wave transformers with one dielectric quarter-wave transformer centered to a ferrite element and the other dielectric quarter-wave transformer offset from the centerline of the ferrite element according to one embodiment of the present invention.
Figure 12:
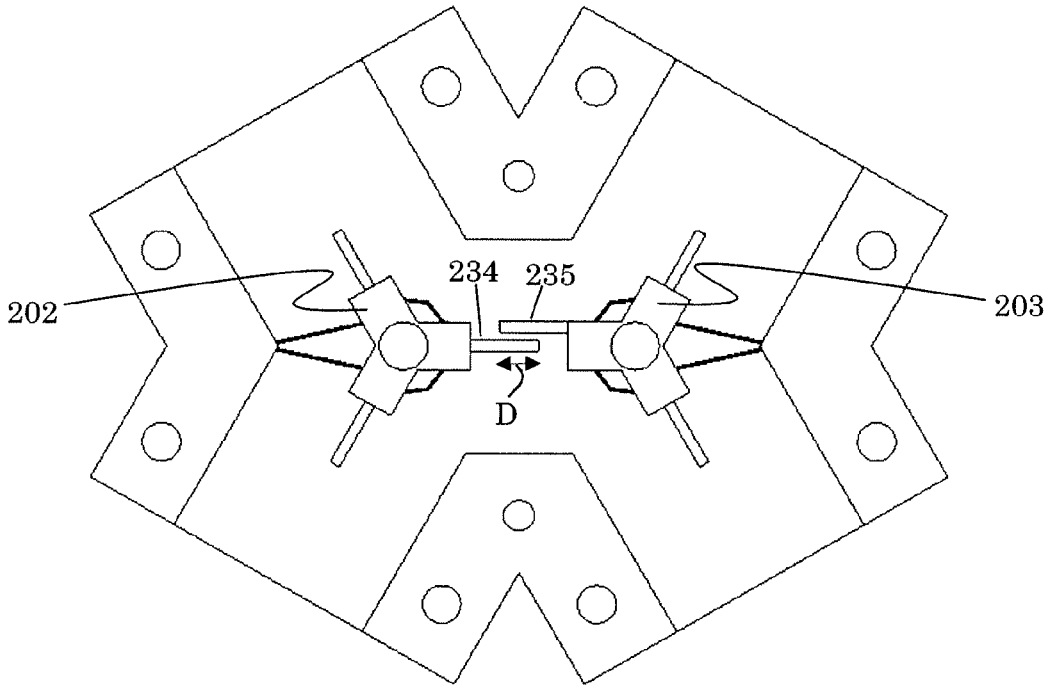
FIG. 12 shows a top view of the structure shown in FIG. 11.

Referring now to FIG. 11, there is shown a perspective view of another embodiment of the device according to the present invention. FIG. 12 contains a top view of the embodiment of FIG. 11. This embodiment illustrates that the quarter-wave dielectric transformers 234 and 235 may be located asymmetrically with respect to the center line of the waveguide width. FIG. 12 shows that quarter-wave dielectric transformer 234 is centered with respect to ferrite element 202 and the center line of the waveguide, but quarter-wave dielectric transformer 235 is aligned to the outside edge of ferrite element 203. Note that the FIG. 11 and FIG. 12 embodiment utilizes the same overlap length "D" between the two quarter-wave dielectric transformers 233 as in previous embodiments.

Figure 13:
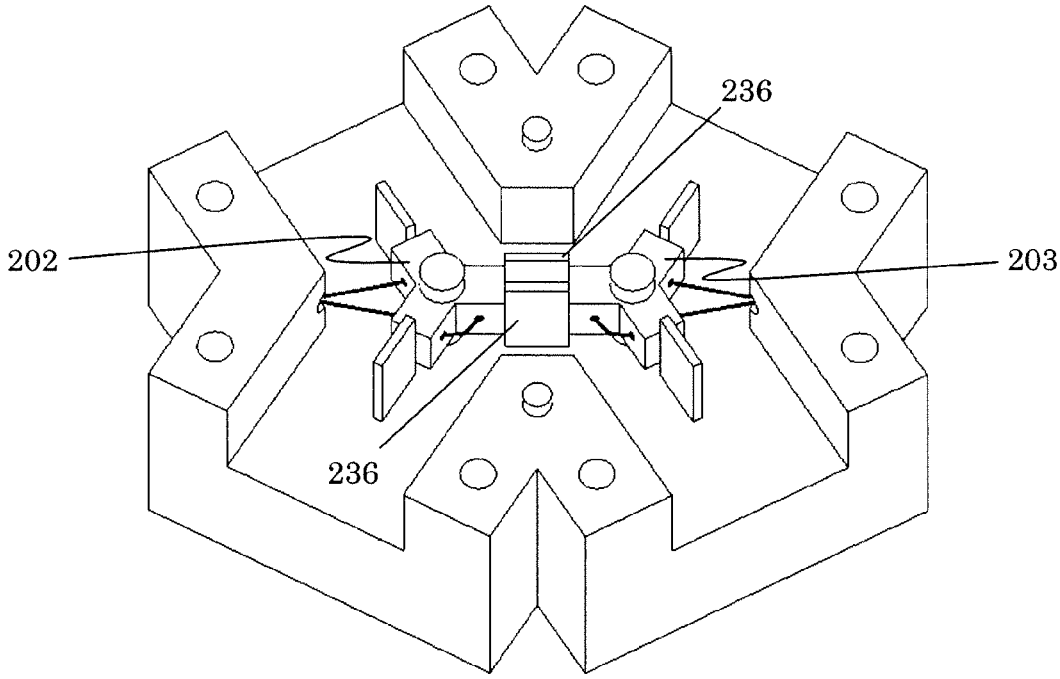
FIG. 13 shows a perspective view of the internal portion of a two-junction waveguide circulator structure incorporating two fully overlapping dielectric quarter-wave transformers offset from center and aligned with the opposite edges of the ferrite elements according to one embodiment of the present invention.
Figure 14:
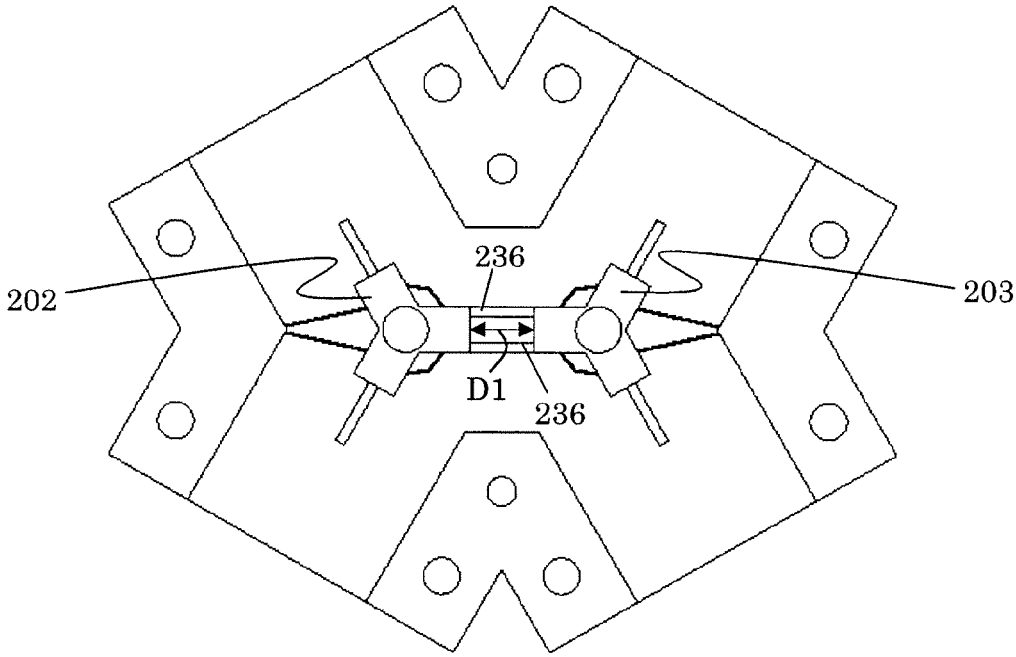
FIG. 14 shows a top view of the structure shown in FIG. 13.

Referring now to FIG. 13, there is shown a perspective view of another embodiment of the device according to the present invention. FIG. 14 contains a top view of the embodiment of FIG. 13. This embodiment is similar to that of FIG. 7 and FIG. 8, but the ferrite elements 202 and 203 are separated by a shorter distance "D1," which is equal in length to a single quarter-wave dielectric transformer 236. This embodiment reflects a complete 100% overlap of the quarter-wave dielectric transformers 236 and thus "D1" is the minimum separation distance possible using the new invention, equal to one-quarter wavelength.

Figure 15:
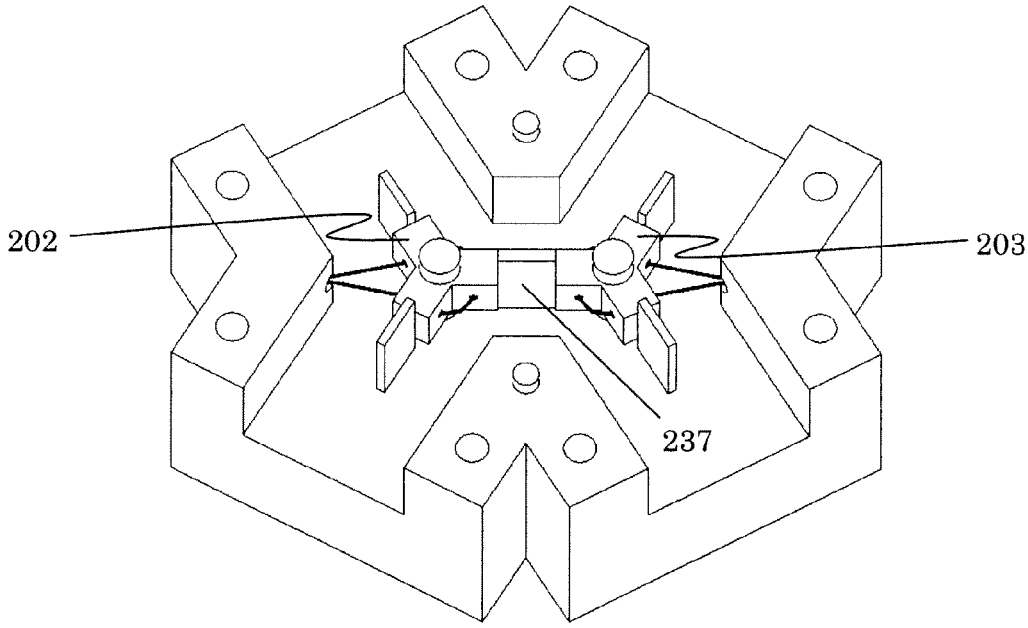
FIG. 15 shows a perspective view of the internal portion of a two-junction waveguide circulator structure incorporating two fully overlapping dielectric quarter-wave transformers manufactured as a single piece according to one embodiment of the present invention.
Figure 16:
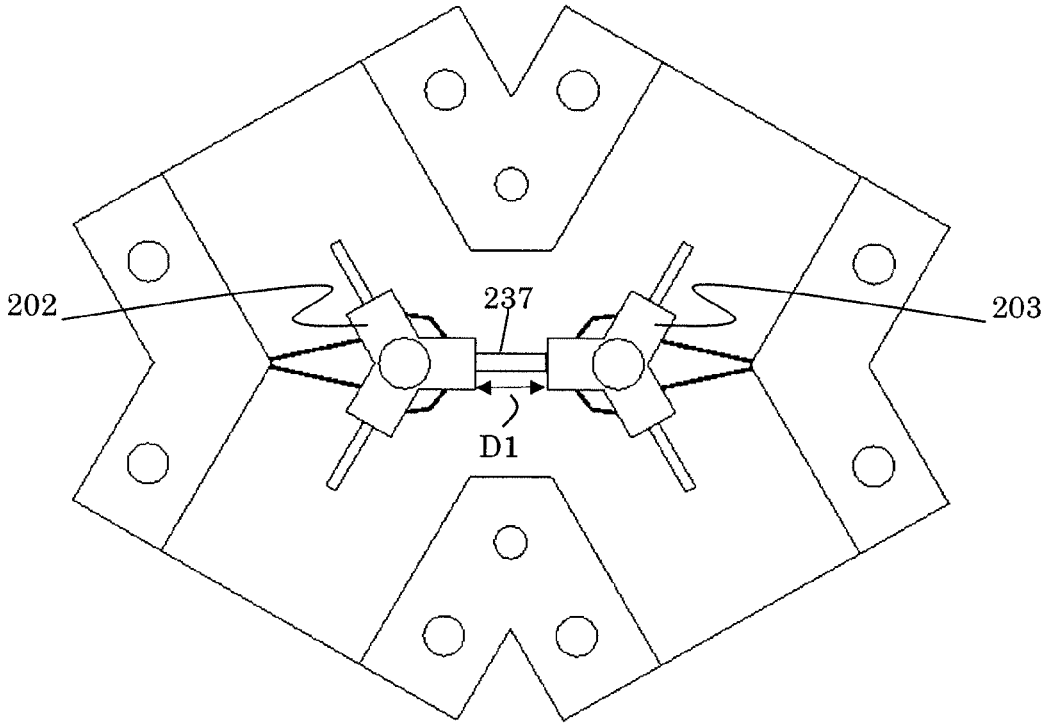
FIG. 16 shows a top view of the structure shown in FIG. 15.

Referring now to FIG. 15, there is shown a perspective view of another embodiment of the device according to the present invention. FIG. 16 contains a top view of the embodiment of FIG. 15. This embodiment is similar to that of FIG. 5 and FIG. 6 in that two individual quarter-wave dielectric transformers have been replaced by a single transformer 237, but the ferrite elements 202 and 203 are now separated by a shorter distance "D1," which is equal in length to a single quarter-wave dielectric transformer 237. This embodiment reflects a complete 100% overlap of the quarter-wave dielectric transformers 236 and thus "D1" is the minimum separation distance possible using the new invention, equal to one-quarter wavelength.

Figure 17:
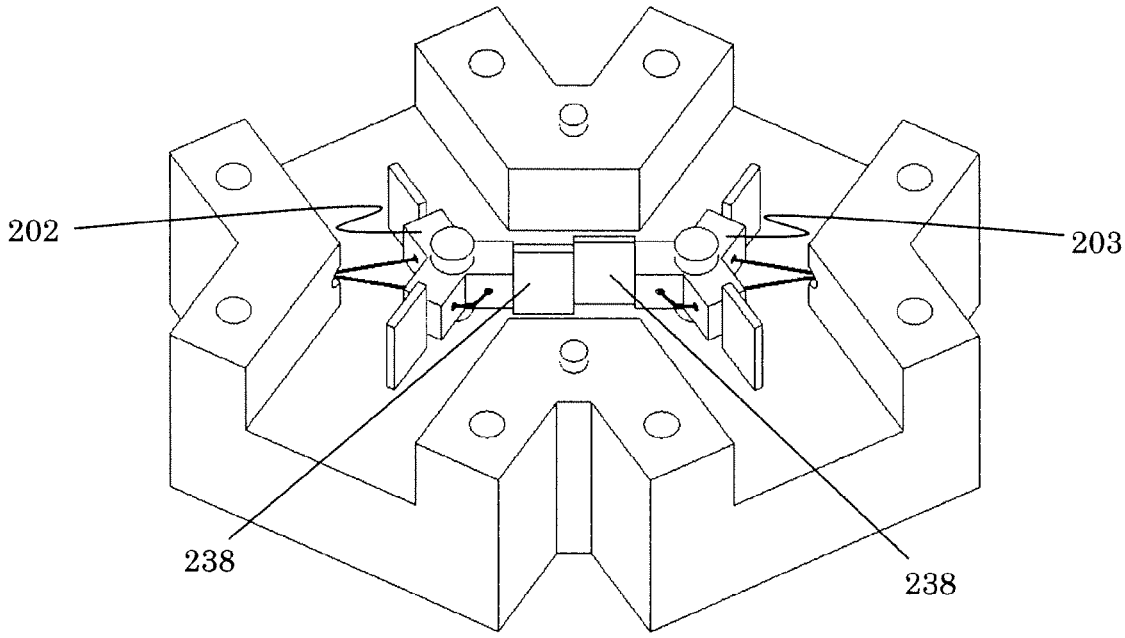
FIG. 17 shows a perspective view of the internal portion of a two-junction waveguide circulator structure incorporating two minimally overlapping dielectric quarter-wave transformers slightly offset from center according to one embodiment of the present invention.
Figure 18:
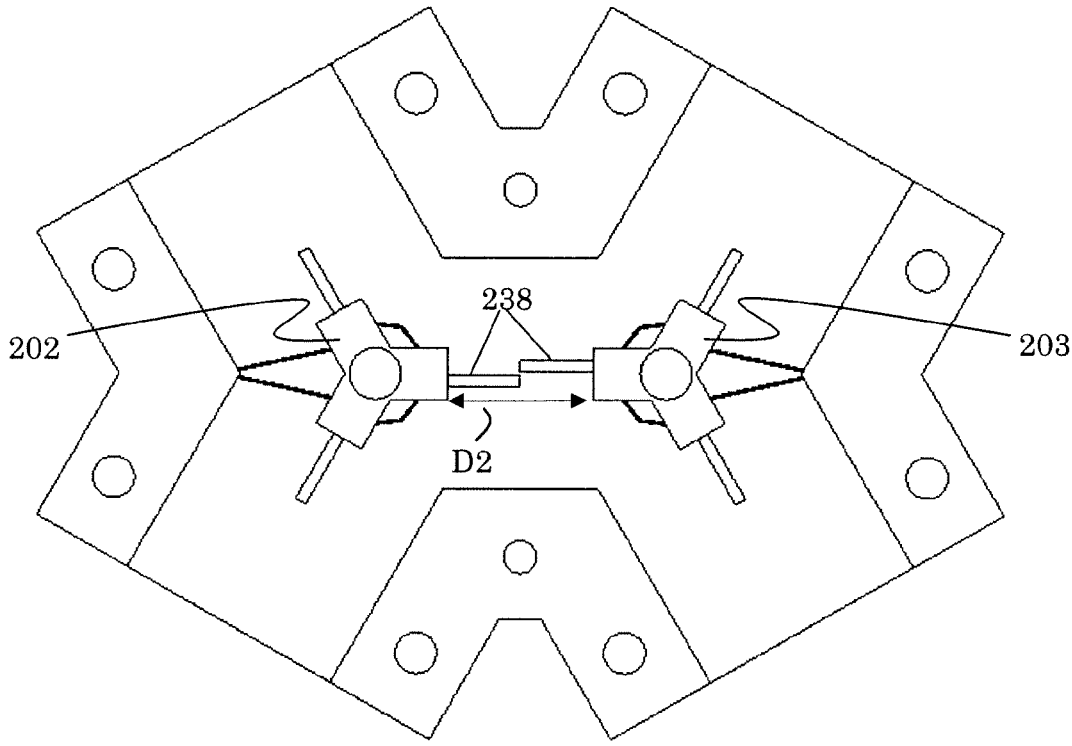
FIG. 18 shows a top view of the structure shown in FIG. 17.

Referring now to FIG. 17, there is shown a perspective view of another embodiment of the device according to the present invention. FIG. 18 contains a top view of the embodiment of FIG. 17. This embodiment is similar to that of FIG. 2 and FIG. 3, but the ferrite elements 202 and 203 are separated by a longer distance "D2," which is equal in length to the sum of the lengths of the two quarter-wave dielectric transformers 238. This embodiment reflects a minimum 0% overlap of the quarter-wave dielectric transformers 238 and thus "D2" is the maximum separation distance possible using the new invention, equal to one-half wavelength. As made clear in FIGS. 17 and 18 for the purposes of this invention, a 0% overlap is defined as being equal to (and no greater than) the length of the sum of the lengths of the two quarter-wave dielectric transformers. Thus, this embodiment differs from the FIG. 1 prior art in that there is no air-filled waveguide section of length "G" between the two quarter-wave dielectric transformers 238.

Figure 19:
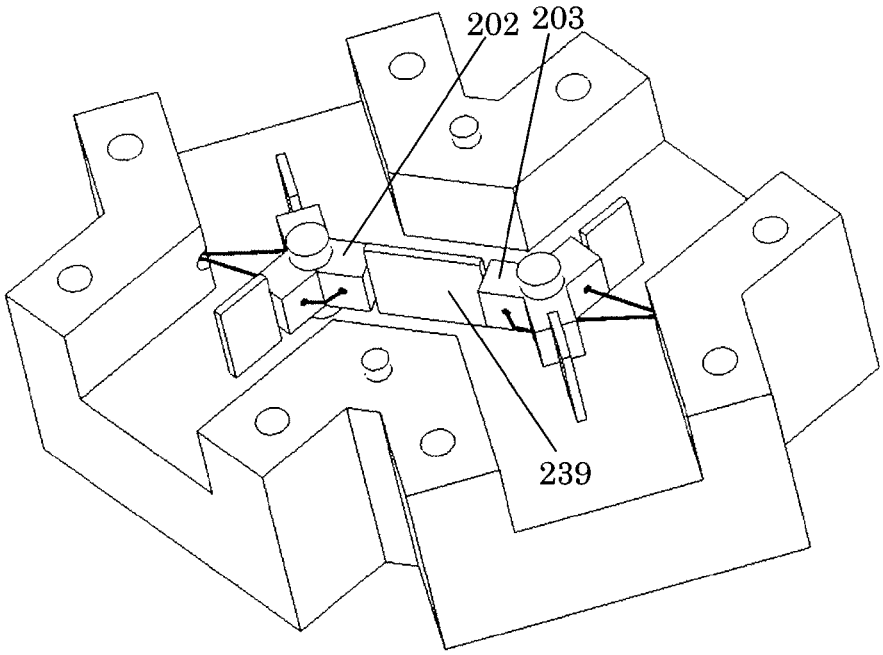
FIG. 19 shows a perspective view of the internal portion of a two-junction waveguide circulator structure incorporating two minimally overlapping dielectric quarter-wave transformers manufactured as a single piece according to one embodiment of the present invention.
Figure 20:
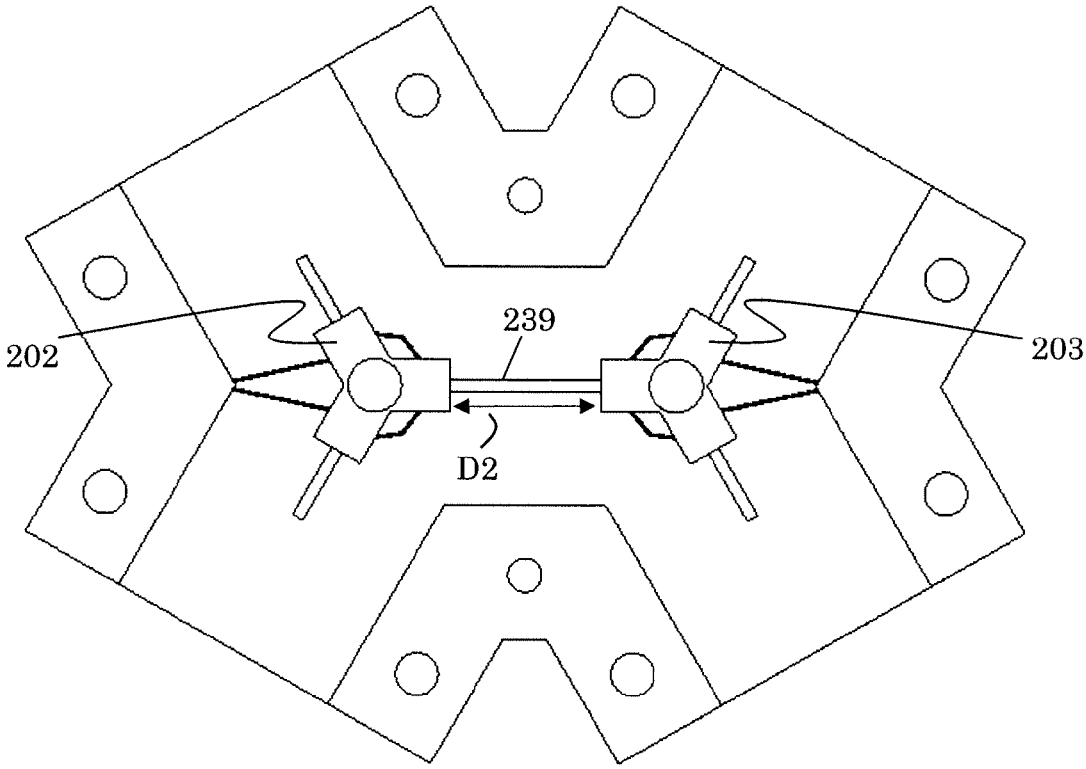
FIG. 20 shows a top view of the structure shown in FIG. 19.

Referring now to FIG. 19, there is shown a perspective view of another embodiment of the device according to the present invention. FIG. 20 contains a top view of the embodiment of FIG. 19. This embodiment is similar to that of FIG. 17 and FIG. 18, but the two quarter-wave dielectric transformers 238 have been combined into a single half-wave dielectric transformer 239. This half-wave dielectric transformer 239 can be aligned with the center line of the ferrite elements 202 and 203 as shown in FIG. 20. This embodiment reflects a minimum 0% overlap of the quarter-wave dielectric transformers 239 and thus "D2" is the maximum separation distance possible using the new invention, equal to one-half wavelength. Note that this embodiment differs from the FIG. 1 prior art in that there is no air-filled waveguide section of length "G" between the two quarter-wave dielectric transformers 239.

Figure 21:
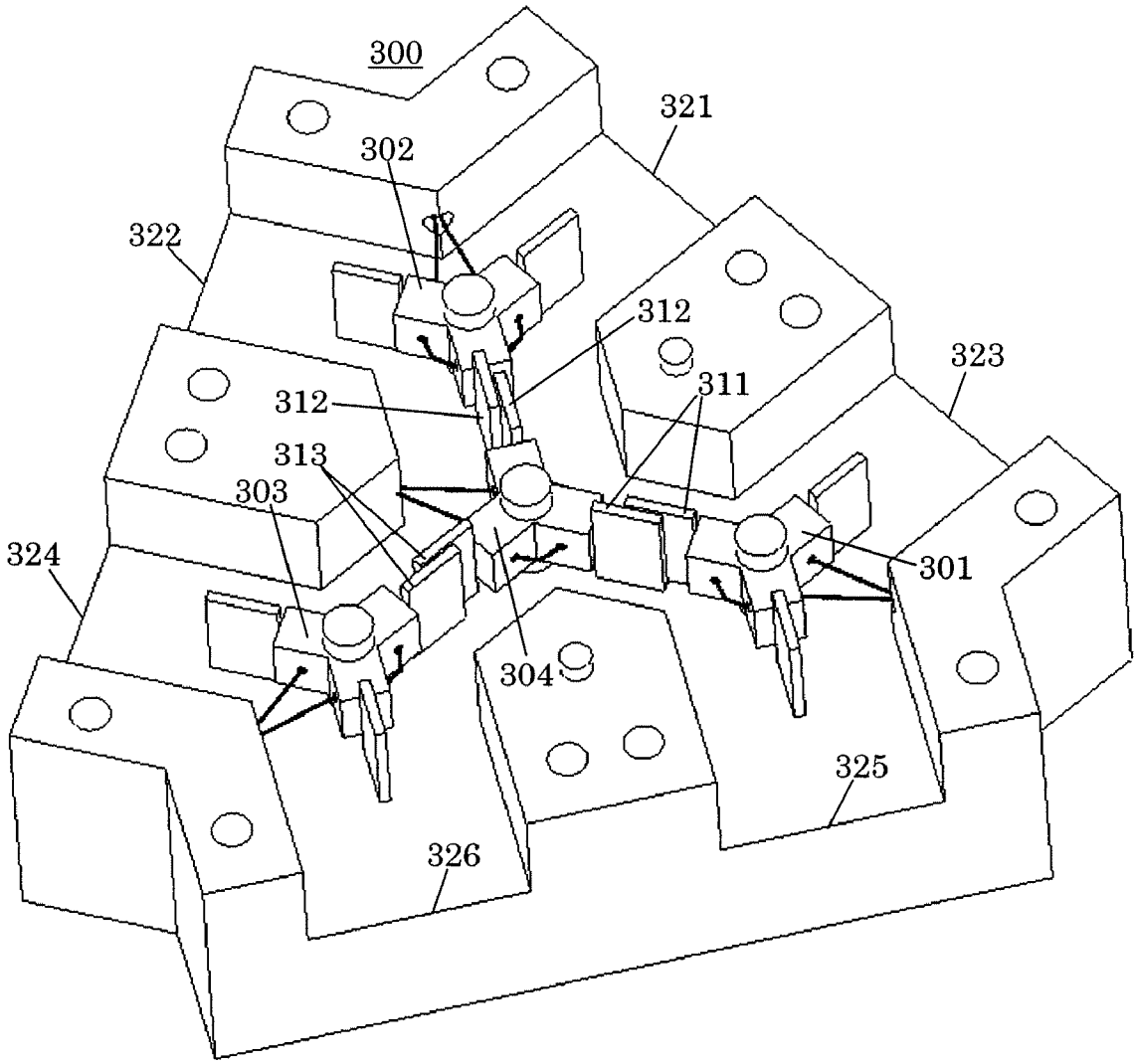
FIG. 21 shows a perspective view of the internal portion of a four-junction waveguide circulator structure incorporating three pairs of partially overlapping dielectric quarter-wave transformers slightly offset from center according to one embodiment of the present invention.
Figure 22:
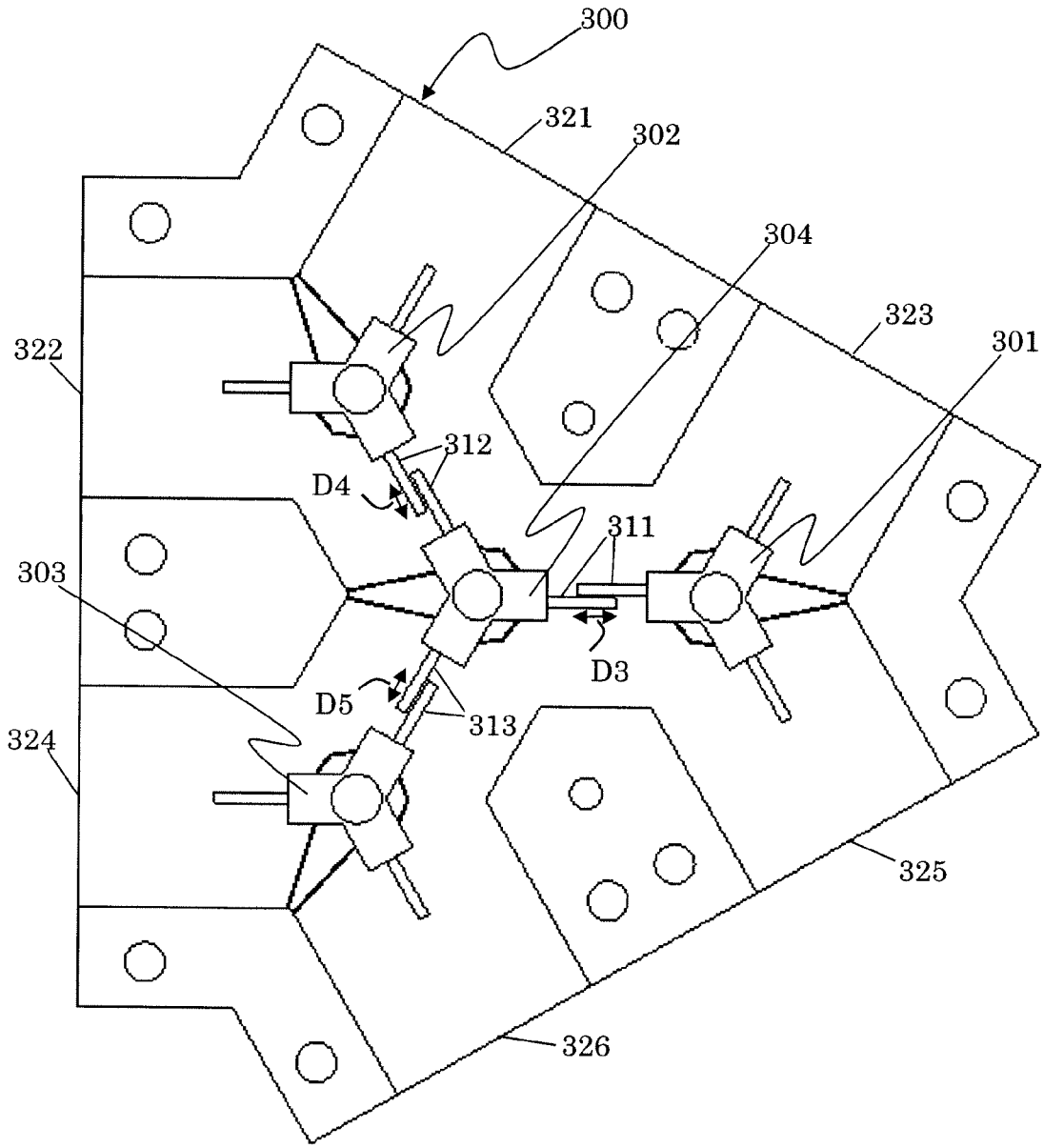
FIG. 22 shows a top view of the structure shown in FIG. 21.

Referring now to FIG. 21, there is shown a perspective view of another embodiment of the device according to the present invention. FIG. 22 contains a top view of the embodiment of FIG. 21. This embodiment is similar to that of FIG. 2 and FIG. 3, but it contains four ferrite elements 301, 302, 303, and 304 instead of two. In operation as a 1 input/5 output switch, an RF signal is provided as input to the waveguide port 321 and is delivered as output through either waveguide port 322, 323, 324, 325, or 326. The center ferrite element 304 has adjacent ferrite elements 301, 302, and 303 on all three legs. As shown in FIG. 21 and FIG. 22, the quarter-wave dielectric transformers 311, 312, and 313 that are attached to the adjacent legs of the ferrite elements overlap along the length of the transformers so that portions of both transformers are contained within the same section of waveguide. In FIG. 22, the length of the overlapping region between the adjacent quarter-wave dielectric transformers 311, 312, and 313 is denoted as "D3," "D4," and "D5," respectively. It is important to note that there are no air-filled waveguide section separating the center ferrite element 304 from the adjacent ferrite elements 301, 302, and 303. The waveguide region between the ferrite elements contains either one or two quarter-wave dielectric transformers 311, 312, and 313 along the entire length. As illustrated in FIG. 22, the overlap "D3," "D4," and "D5," of the adjacent quarter-wave dielectric transformers 311, 312, and 313 is roughly 50% of their length or one-eighth of a wavelength. This results in a spacing of approximately three-eighths of a wavelength between the ferrite elements. The overlap percent of the adjacent quarter-wave dielectric transformers 311, 312, and 313 can vary independent of one another and can range from 0% to 100%. As shown in FIG. 22, the adjacent quarter-wave dielectric transformers 311, 312, and 313 are spaced very closely to one another along the waveguide width (the direction perpendicular to "D3," "D4," and "D5"), leaving a de minimus air gap. As previously illustrated for the two-junction waveguide circulator structures, variations ranging from a zero length gap to a gap several times wider than the quarter-wave dielectric transformers are possible.

Figure 23:
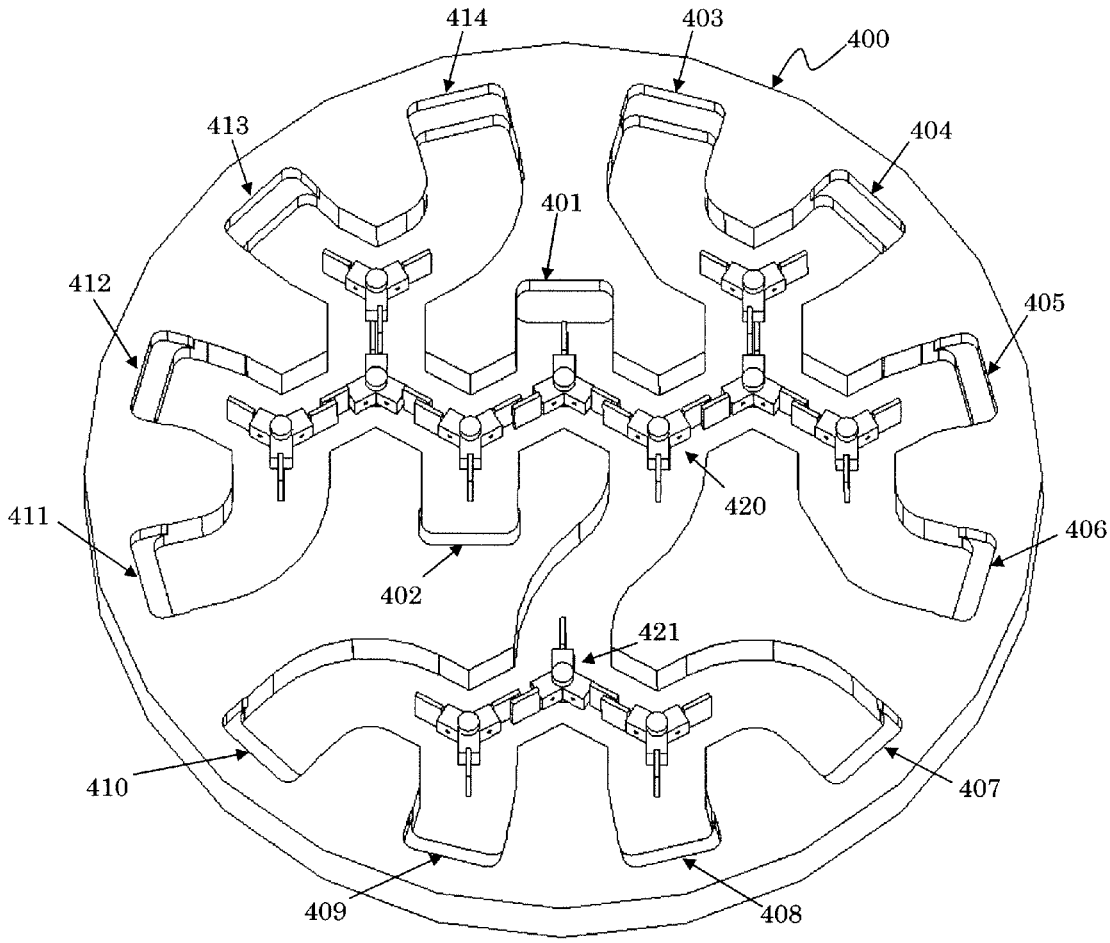
FIG. 23 shows a perspective view of the internal portion of a twelve-junction waveguide circulator structure incorporating ten pairs of partially overlapping dielectric quarter-wave transformers slightly offset from center according to one embodiment of the present invention.
Figure 24:
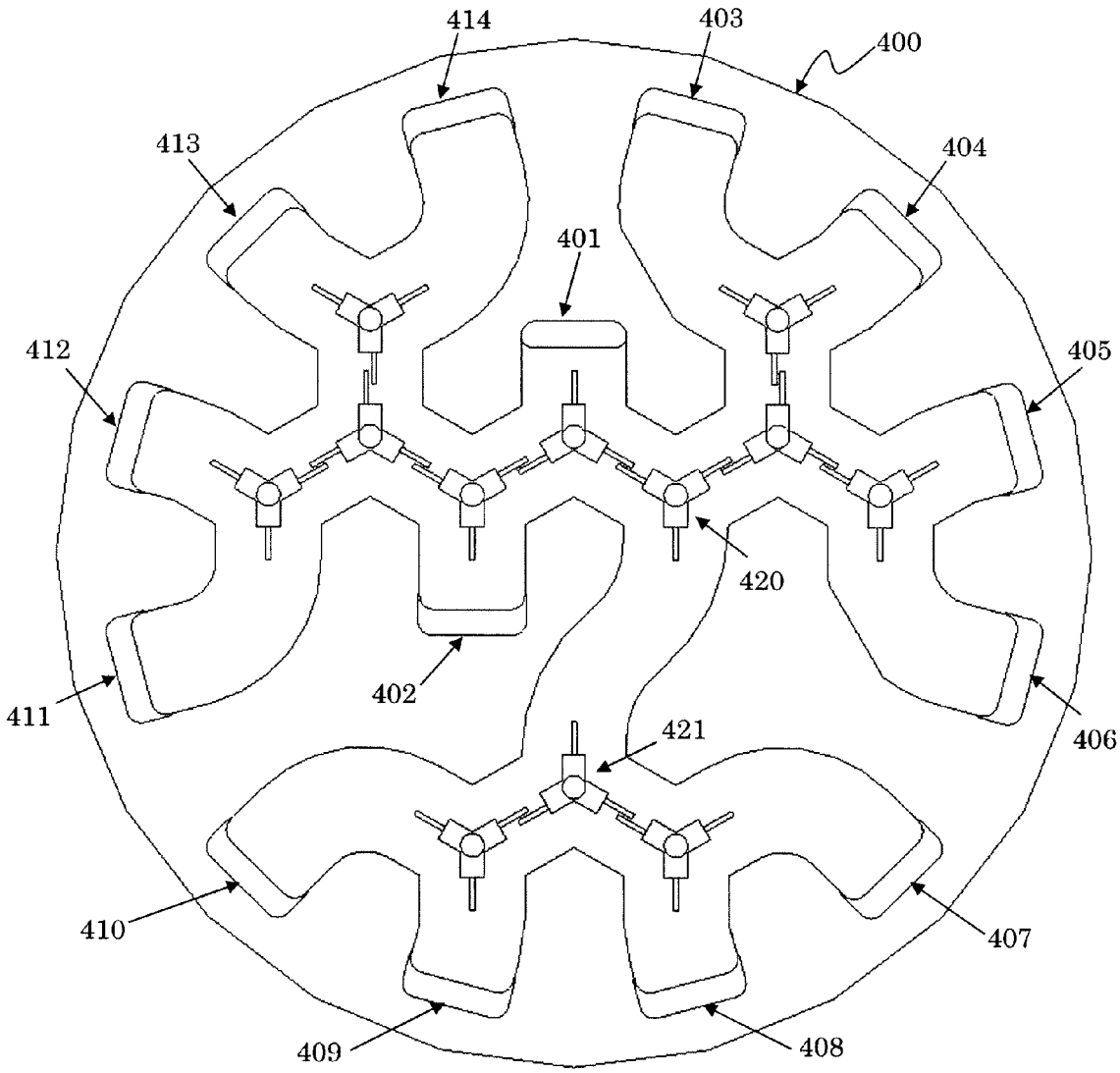
FIG. 24 shows a top view of the structure shown in FIG. 23.

Referring now to FIG. 23, there is shown a perspective view of another embodiment of the device according to the present invention. FIG. 24 contains a top view of the embodiment of FIG. 23. This embodiment is similar to that of FIG. 21 and FIG. 22, but it contains twelve ferrite elements instead of four. In operation as a 1 input/13 output switch, an RF signal is provided as input to the waveguide port 401 and is delivered as output through either waveguide port 402, 403, 404, 405, 406, 407, 408, 409, 410, 411, 412, 413, or 414. This embodiment further illustrates the value of this invention in reducing the size of large multi-port circulator networks. In an exemplary design for the 37 to 40 GHz frequency range, this embodiment has a diameter of approximately 2.1 inches as compared to 3.5 inches using the conventional design methods. Therefore, the new invention provides a 40% reduction in size over the conventional design.

FIGS. 23 and 24 also illustrate how embodiments of the present invention may be combined with elements of conventional waveguide circulator structures to provide desired spacing to create a multi-output switch. Thus, ferrite elements 420 and 421 utilize a conventional air-filled transition between elements 420 and 421, while the remaining transitions include embodiments of the present invention.

Although the exemplary embodiments of the invention are described with respect to a latching circulator switch junction, such as in FIG. 2, the invention can be applied to a fixed circulator junction that uses a current pulse of only one polarity through the magnetizing winding, or to a circulator for which a permanent magnet is used to bias the ferrite element.

While exemplary embodiments of the invention have been shown and described herein, it will be obvious to those skilled in the art that such embodiments are provided by way of example only. Numerous insubstantial variations, changes, and substitutions will now be apparent to those skilled in the art without departing from the scope of the invention disclosed herein by the Applicant. Accordingly, it is intended that the invention be limited only by the spirit and scope of the claims, as they will be allowed.

I claim:

1. A ferrite circulator, comprising:

a waveguide structure having an internal cavity, the waveguide structure including a plurality of ports extending from the internal cavity; and at least two ferrite elements disposed in the internal cavity, wherein a first ferrite element has a first quarter-wave dielectric transformer, wherein an adjacent second ferrite element has a second quarter-wave dielectric transformer, and wherein at least a portion of the first and second quarter-wave dielectric transformers overlap along a length of the internal cavity.

2. The ferrite circulator according to claim 1, wherein each of the at least two ferrite elements are separated by a distance between one-quarter and one-half wavelength of a waveguide wavelength ±25% at an operating frequency.

3. The ferrite circulator according to claim 1, wherein at least a portion of the first quarter-wave dielectric transformer extends farther from the center line of the waveguide width than does the face of the first ferrite element with which the first quarter-wave dielectric transformer is associated.

4. The ferrite circulator according to claim 1, wherein the first and second quarter-wave dielectric transformers are located asymmetrically with respect to the center line of the waveguide width.

5. The ferrite circulator according to claim 1, further comprising a magnetizing winding in each of the at least two ferrite elements.

6. The ferrite circulator according to claim 1, further comprising at least one empirical matching element disposed within the internal cavity.

7. The ferrite circulator according to claim 1, wherein the at least two ferrite elements are Y-shaped.

8. The ferrite circulator according to claim 1, wherein the first quarter-wave dielectric transformer and the second quarter-wave dielectric transformer are parallel.

9. The ferrite circulator according to claim 1, wherein a gap exists between the first and second quarter-wave dielectric transformers.

10. The ferrite circulator according to claim 9, wherein the gap is a de minimus gap.

11. The ferrite circulator according to claim 9, wherein the gap is a greater than the width of the quarter-wave dielectric transformers.

12. The ferrite circulator according to claim 1, wherein the first quarter-wave dielectric transformer and the second quarter-wave dielectric transformer form a continuous piece.

13. The ferrite circulator according to claim 12, wherein each of the at least two ferrite elements are separated by a distance between one-quarter and one-half wavelength of a waveguide wavelength ±25% at an operating frequency.

14. The ferrite circulator according to claim 12, wherein the continuous piece is located asymmetrically with respect to the center line of the waveguide width.

15. A ferrite circulator, comprising:

a waveguide structure having an internal cavity, the waveguide structure including a plurality of ports extending from the internal cavity;

at least two ferrite elements disposed in the internal cavity, and a single transformer located between said at least two ferrite elements, said single transformer having the functionality of two quarter-wave dielectric transformers, said first ferrite element and said second ferrite element being separated by a distance between no more than the length of two quarter-wave dielectric transformers at an operating frequency.

16. The ferrite circulator according to claim 15, wherein said first ferrite element and said second ferrite element being separated by a distance between the length of one quarter-wave dielectric transformer and two quarter-wave dielectric transformers at an operating frequency.

17. The ferrite circulator according to claim 15, wherein the single transformer is located asymmetrically with respect to the center line of the waveguide width.

18. The ferrite circulator according to claim 15, further comprising a magnetizing winding in each of the at least two ferrite elements.

19. The ferrite circulator according to claim 15, further comprising at least one dielectric spacer disposed on an outer surface of the at least two ferrite elements.

20. The ferrite circulator according to claim 15, further comprising at least one empirical matching element disposed within the internal cavity.

21. A ferrite circulator, comprising:

a waveguide structure having an internal cavity, the waveguide structure including a plurality of ports extending from the internal cavity;

a first ferrite element disposed in the internal cavity, said first ferrite element having at least a first and a second quarter-wave dielectric transformer;

a second ferrite element disposed in the internal cavity adjacent to said first ferrite element, said second ferrite element having a third quarter-wave dielectric transformer disposed such that at least a portion of the first and third quarter-wave dielectric transformers overlap along a length of the internal cavity; and separated by a distance between no more than the length of two quarter-wave dielectric transformers at an operating frequency; and a third ferrite element disposed in the internal cavity adjacent to said first ferrite element, said third ferrite element having a fourth quarter-wave dielectric transformer, said third ferrite element disposed such that no portion of the second and fourth quarter-wave dielectric transformers overlap along a length of the internal cavity.

* * * * *